US009854910B2

(12) United States Patent
Cattaneo

(10) Patent No.: US 9,854,910 B2
(45) Date of Patent: Jan. 2, 2018

(54) ADJUSTABLE WALL CUPBOARD HOLDER GROUP FOR ANCHORING A CUPBOARD TO THE WALL

(75) Inventor: Carlo Cattaneo, Figino Serenza-Como (IT)

(73) Assignee: LEONARDO S.R.L., Figino Serenza Como (IT)

( * ) Notice: Subject to any disclaimer, the term of this patent is extended or adjusted under 35 U.S.C. 154(b) by 114 days.

(21) Appl. No.: 12/735,291

(22) PCT Filed: Jul. 24, 2009

(86) PCT No.: PCT/EP2009/005627

§ 371 (c)(1),
(2), (4) Date: Jun. 29, 2010

(87) PCT Pub. No.: WO2010/012503

PCT Pub. Date: Feb. 4, 2010

(65) Prior Publication Data

US 2010/0282934 A1 Nov. 11, 2010

(30) Foreign Application Priority Data

Jul. 29, 2008 (IT) ..... MI2008A1393

(51) Int. Cl.
*A47B 95/00* (2006.01)

(52) U.S. Cl.
CPC ..... *A47B 95/008* (2013.01)

(58) Field of Classification Search
CPC ..... A47B 95/008; A47B 96/07; F16B 12/36; F16B 12/10; F16B 2/065
USPC ..... 312/245, 257.1, 263, 111; 248/220.21, 248/221.11, 222.51, 223.31, 225.21, 248/222.14, 225.11
See application file for complete search history.

(56) References Cited

U.S. PATENT DOCUMENTS 4,016,703 A * 4/1977 Champoux et al. ..... 403/404
4,432,680 A * 2/1984 Molina ..... 411/103
4,799,290 A * 1/1989 Lautenschlager, Jr. ..... 16/237
(Continued)

FOREIGN PATENT DOCUMENTS

DE 295 07 071 U1 8/1995
DE 201 03 728 U1 5/2001
(Continued)

OTHER PUBLICATIONS

PCT Search Report dated Nov. 19, 2009.

*Primary Examiner* — Daniel J Troy
*Assistant Examiner* — Hiwot Tefera
(74) *Attorney, Agent, or Firm* — Hedman & Costigan, P.C.; James V. Costigan; Kathleen A. Costigan

(57) ABSTRACT

An adjustable wall cupboard holder group (10) for anchoring a cupboard (11) to the wall having a hook (15) situated at the free end of a hooking element (14) extending externally from the wall cupboard holder group. A regulation mechanism of the positions in depth and height of the hook (15) is associated with the hooking element (14). The wall cupboard holder group includes a central section or portion (16) containing the hooking element (14) and mechanism, and two side sections or flanges (18, 18'), at least one element (20, 20') resistant to shear forces, protruding from at least one of said sections, where at least the other section includes at least one fixing device (19, 19').

8 Claims, 8 Drawing Sheets

(56) References Cited

U.S. PATENT DOCUMENTS

| | | | | | |
|---|---|---|---|---|---|
| 4,807,947 | A * | 2/1989 | Nuzzo | 312/140.4 |
| 4,862,556 | A * | 9/1989 | Grass | 16/382 |
| 4,874,212 | A * | 10/1989 | Rock et al. | 312/330.1 |
| 4,936,534 | A * | 6/1990 | Cattaneo | 248/223.41 |
| 4,982,476 | A * | 1/1991 | Salice | 16/382 |
| 5,090,652 | A * | 2/1992 | Cattaneo | 248/222.14 |
| 5,358,205 | A * | 10/1994 | Starkey et al. | 248/220.21 |
| 5,525,005 | A * | 6/1996 | Chen | 403/374.4 |
| 5,607,271 | A * | 3/1997 | Salice | 411/349 |
| 5,611,637 | A * | 3/1997 | Brustle et al. | 403/297 |
| 5,930,883 | A * | 8/1999 | McWhirt et al. | 29/434 |
| 5,966,779 | A * | 10/1999 | Salice | 16/382 |
| 6,254,207 | B1 * | 7/2001 | Leneutre | 312/263 |
| 6,739,019 | B2 * | 5/2004 | Schnelle et al. | 16/235 |
| 7,490,385 | B2 * | 2/2009 | Migli | 16/246 |
| 8,020,824 | B2 * | 9/2011 | Pan | 248/299.1 |
| 2005/0110374 | A1 * | 5/2005 | Hwang et al. | 312/257.1 |
| 2006/0102247 | A1 * | 5/2006 | Green | 144/24.12 |
| 2011/0062297 | A1 * | 3/2011 | Cattaneo | 248/222.14 |

FOREIGN PATENT DOCUMENTS

| | | | | |
|---|---|---|---|---|
| EP | 0 033 179 | A1 | 8/1981 | |
| EP | 0033179 | A1 * | 8/1981 | A47B 95/008 |
| EP | 0 632 979 | A1 | 1/1995 | |
| EP | 1 228 720 | A1 | 8/2002 | |
| EP | 1228720 | A1 * | 8/2002 | |
| WO | WO 2004032681 | A1 * | 4/2004 | A47B 95/00 |

* cited by examiner

Fig. 2
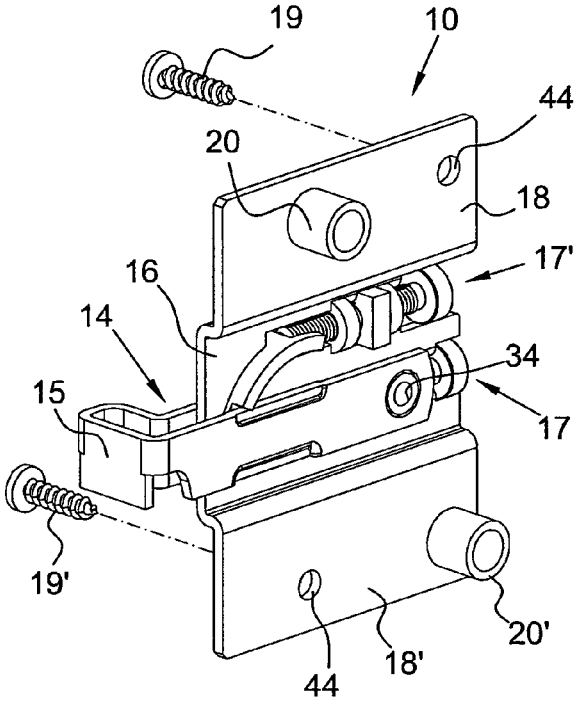
Fig. 2b
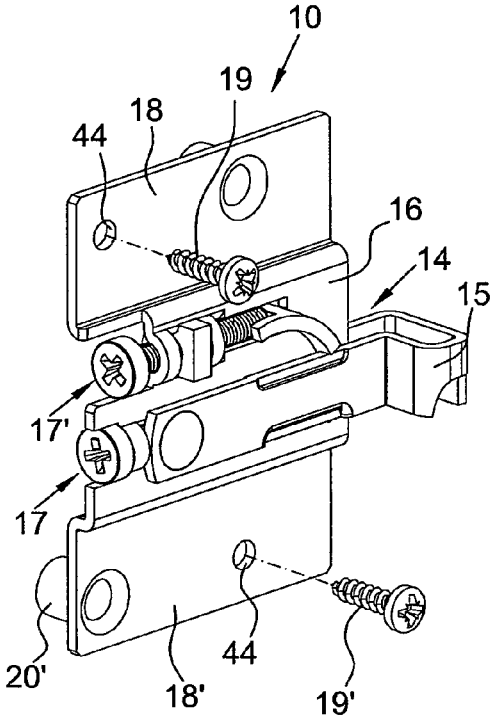
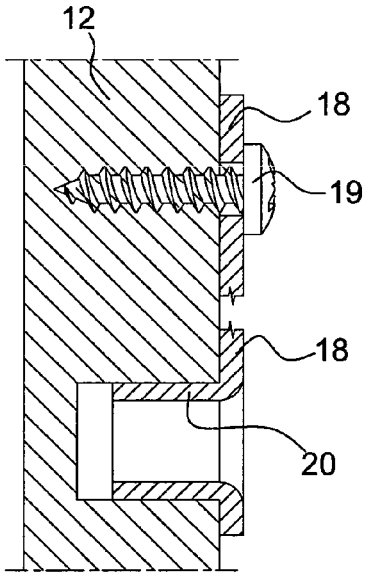
Fig. 2c

Fig. 3
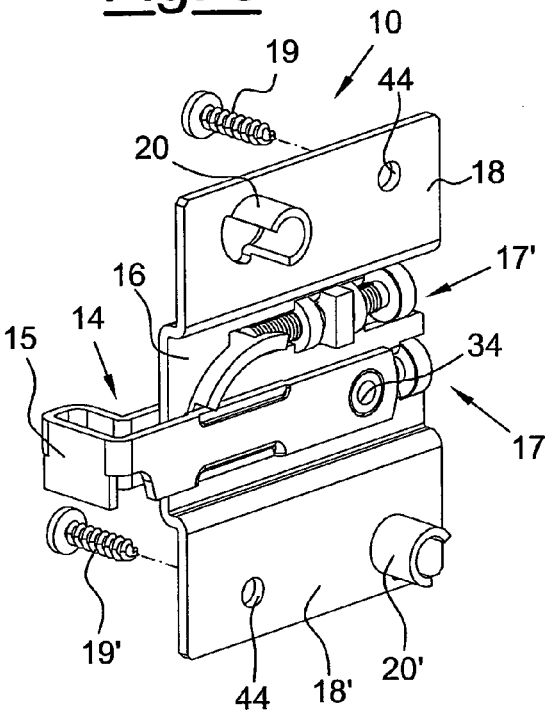
Fig. 3b
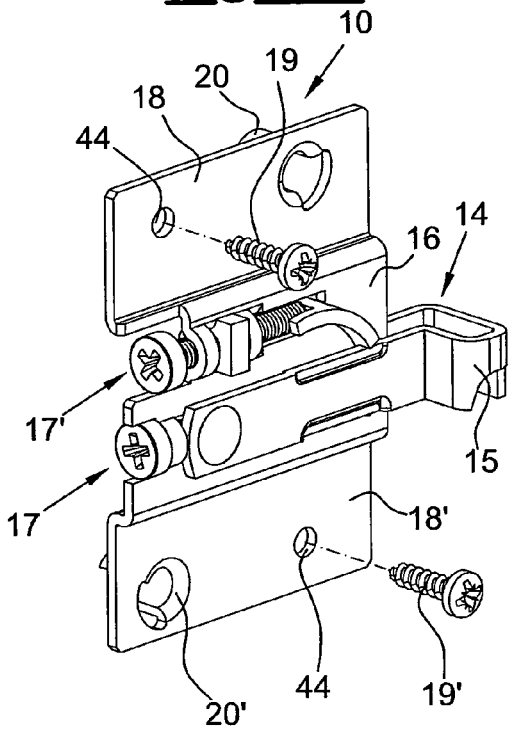
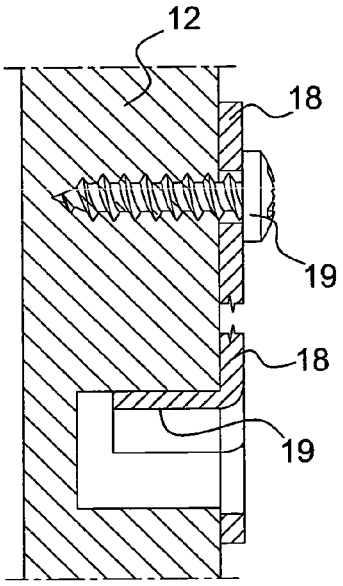
Fig. 3c

Fig. 4
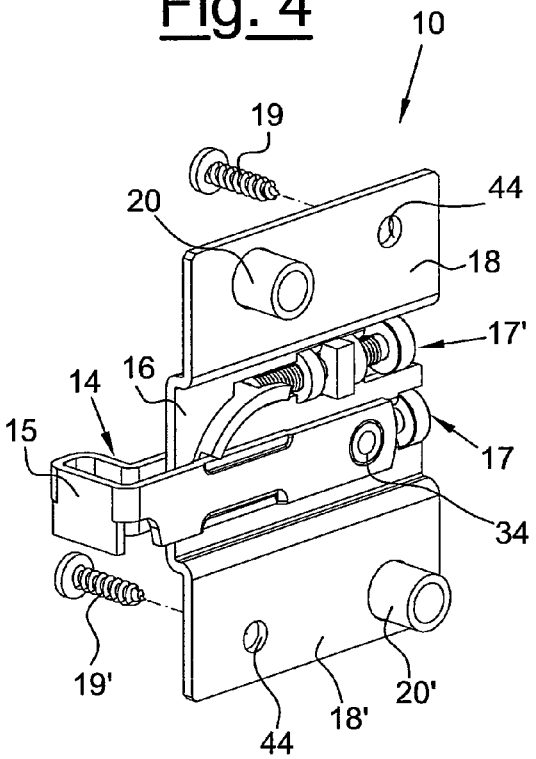
Fig. 4b
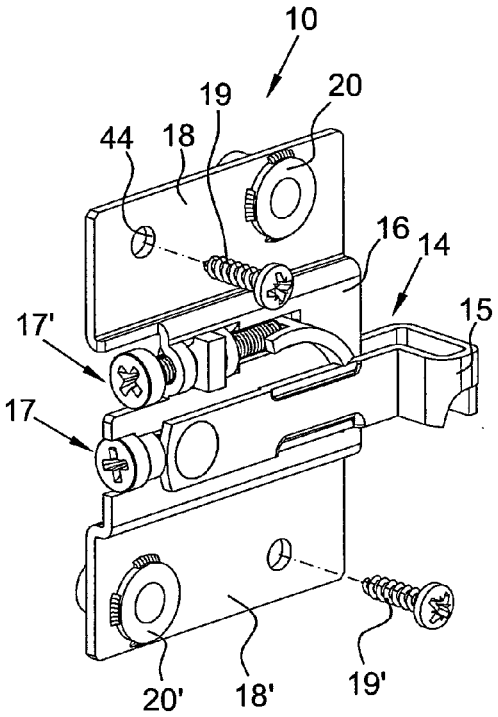
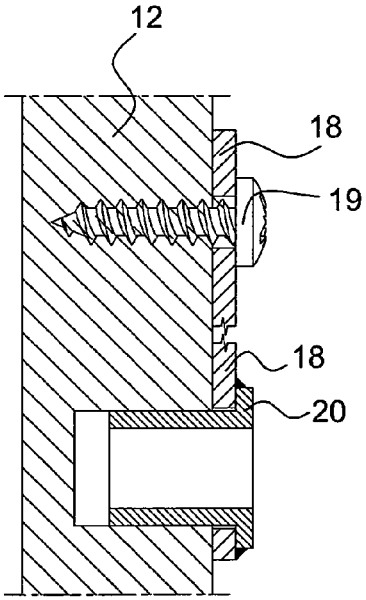
Fig. 4c

Fig. 5
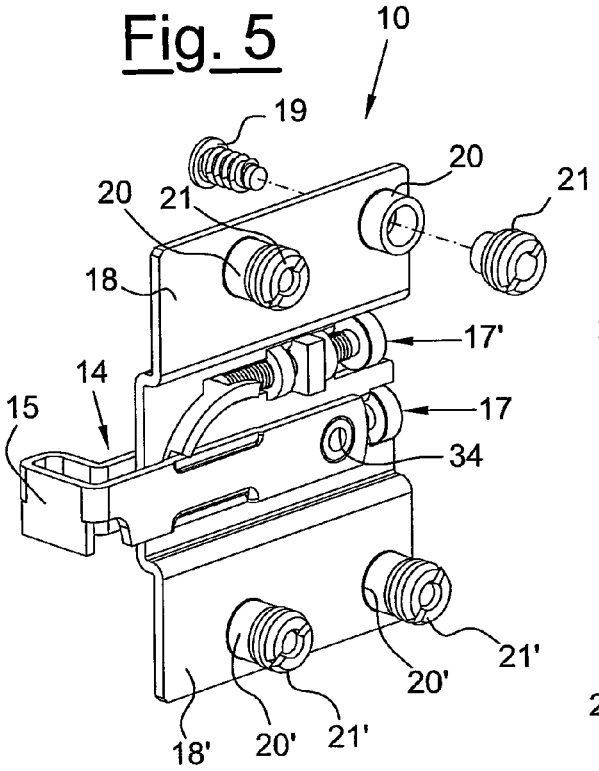
Fig. 5b
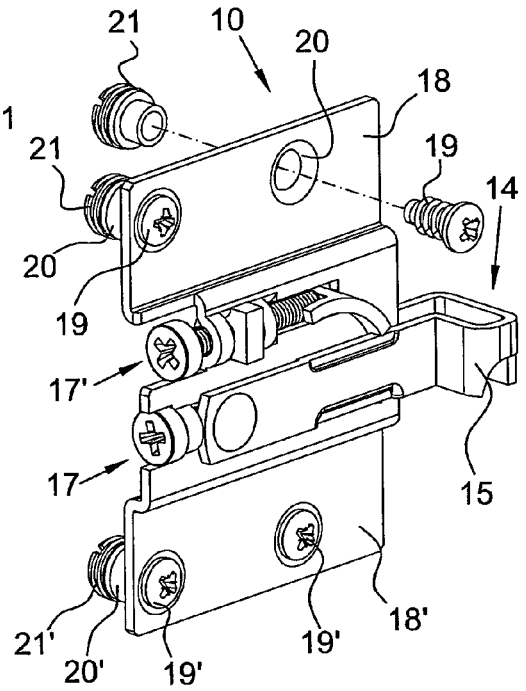
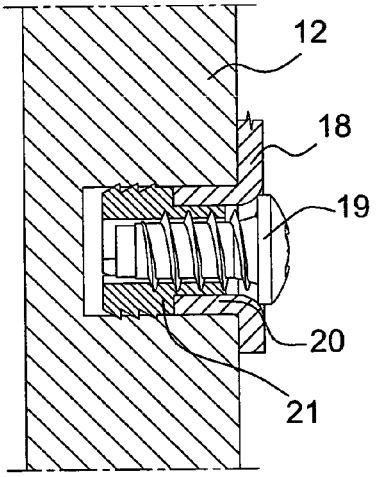
Fig. 5c

Fig. 6
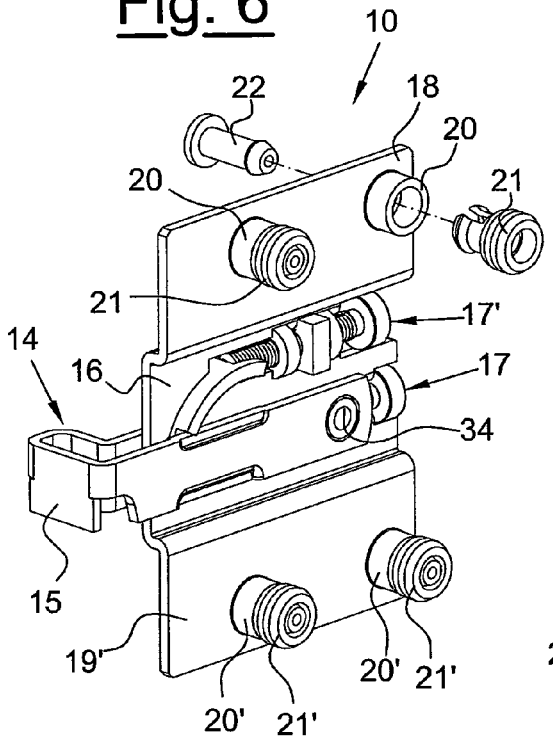
Fig. 6b
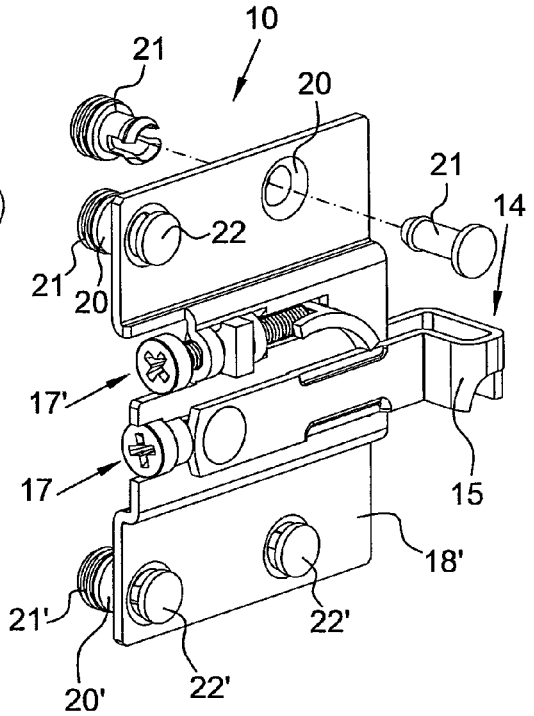
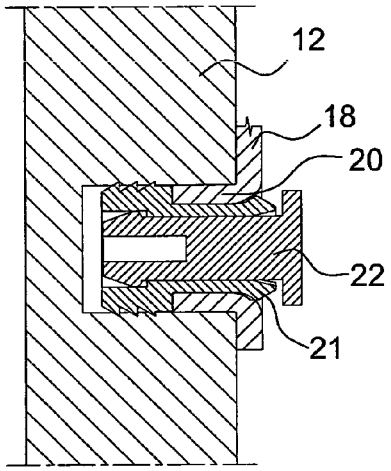
Fig. 6c

ADJUSTABLE WALL CUPBOARD HOLDER GROUP FOR ANCHORING A CUPBOARD TO THE WALL

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION BY-REFERENCE OF MATERIAL SUBMITTED ON A COMPACT DISK

Not Applicable

REFERENCE TO MICROFICHE APPENDIX

Not Applicable

BACKGROUND OF THE INVENTION

Field of the Invention

The present invention relates to a visible wall cupboard holder group, adjustable for anchoring a cupboard to the wall.

In particular, the wall cupboard holder in question is defined as being visible as it is destined for being assembled inside a wall cupboard.

Description of Related Art

Wall cupboard holders in which a hook is situated at the free end of an arm which extends externally from a box-shaped body made of plastic material, are well known to experts in the field.

Said box-shaped body contains a mechanism for regulating the positions in depth and height of the hook, which is to be hooked to a wall support, a shaped metallic section, peg or other similar item.

The wall cupboard holder thus structured is fixed to the shoulder of the cupboard by means of self-threading screws, or pressure-yielding plugs made of a plastic material, with a saw-toothed profile, in correspondence with the upper edges of the cupboard, defined by the shoulder, cover or top.

The screws are pass-through, i.e. they pass through the box-shaped body and are screwed directly into the shoulder of the cupboard, whereas the plugs extend integrally and laterally from the box-shaped body made of plastic material and are pressure-inserted into a corresponding seat of the shoulder.

A wall cupboard holder of the type briefly described above is described and illustrated, for example, in patents EP 0033179 B1 and EP 0632979 A1.

There are also other types of wall cupboard holders which substantially differ in the supports with which they are fixed to the cupboards and also in the means with which it is possible to regulate the positions in depth and height (inclination) of the rear hook.

These wall cupboard holders, described for example in EP 1228720 B1, at present generally consist of a plate element equipped with a side flange which, in the assembly phase, is normally fixed by means of screws or expansion pegs in holes situated on the shoulder of the wall cupboard.

As mentioned above, the above known wall cupboard holders comprise a moveable hook element for fixing the cupboard to the wall which, as described in EP 1228720 B1, is driven by screw-female screw mechanisms, possibly equipped with angular countershafts, capable of allowing the regulation of the rear position of the supporting hook (see also EP 0033179 B1 and EP 0632979 A1).

Although these known wall cupboard holders are currently functional and satisfy the safety regulations in force in the field of hanging furniture items, in view of the present tendency to reduce the thicknesses of the panels forming wall cupboards and increasing diffusion of these pieces of furniture, which are also frequently overloaded, it can unfortunately happen that this cupboard/cupboard holder coupling is not always effective, long-lasting and above all safe.

As the stability of the wall cupboard depends on this constraint, unfortunately the wall cupboard frequently falls dangerously and/or breaks as a result of the shear forces acting in the wall cupboard holder coupling which are generated when the cupboard is loaded.

The above drawbacks mainly occur in the wall cupboard holders of EP 0033179 B1 and EP 0632979 A1, with a box-shaped body made of plastic material.

A general objective of the present invention is to solve the above drawbacks of the known art in an extremely simple, economical and particularly functional manner.

A further objective is to provide a visible wall cupboard holder group for anchoring a wall cupboard to the wall, which ensures an easy and firm assembly on any type of wall cupboard.

Another objective is to provide a visible wall cupboard holder group for anchoring a wall cupboard to the wall, which is capable of resisting high shear forces which can be generated in the cupboard/wall cupboard holder coupling once the cupboard has been loaded.

In view of the above objectives, according to the present invention, a visible wall cupboard holder group has been conceived for anchoring a cupboard to the wall, having the characteristics specified in the main claim and enclosed subclaims.

BRIEF SUMMARY OF THE INVENTION

The invention provides an adjustable wad cupboard holder group (10) for anchoring a cupboard (11) to the wall comprising a hook (15) situated at the free end of a hooking element (14) extending externally from said wall cupboard holder group, a regulation mechanism of the positions in depth and height of said hook (15) that is associated with said hooking element (14), characterized in that said wall cupboard holder group comprises a central section or portion (16) containing said hooking element (14) and mechanism, and two side sections or flanges (18, 18'), at least one element (20, 20') resistant to shear forces, protruding from at least one of said sections, The structural and functional characteristics of the of the present invention, and its advantages with respect to the known art, will appear more evident from the following description, referring to the enclosed schematic drawings, which illustrate examples of visible wall cupboard holder groups for anchoring a wall cupboard to the wall produced according to the innovative principles of the same invention.

BRIEF DESCRIPTION OF THE SEVERAL VIEWS OF THE DRAWINGS

FIG. 2 is a perspective view of the wall cupboard holder group of FIG. 1 assembled;

FIG. 2*b* is another perspective view of the wall cupboard holder group of FIG. 2;

FIG. 2*c* is an enlarged view of a detail of the wall cupboard holder group of FIGS. 2-2*b* assembled on the relative wall cupboard;

FIG. 3 is a perspective view of another wall cupboard holder group according to the present invention;

FIG. 3*b* is another perspective view of the wall cupboard holder group of FIG. 3;

FIG. 3*c* is an enlarged view of a detail of the wall cupboard holder group of FIGS. 3-3*b* assembled on the relative wall cupboard;

FIG. 4 is a perspective view of another wall cupboard holder group according to the present invention;

FIG. 4*b* is another perspective view of the wall cupboard holder group of FIG. 4;

FIG. 4*c* is an enlarged view of a detail of the wall cupboard holder group of FIGS. 4-4*b* assembled on the relative wall cupboard;

FIG. 5 is a perspective view of another wall cupboard holder group according to the present invention;

FIG. 5*b* is another perspective view of the wall cupboard holder group of FIG. 3;

FIG. 5*c* is an enlarged view of a detail of the wall cupboard holder group of FIGS. 5-5*b* assembled on the relative wall cupboard;

FIG. 6 is a perspective view of another wall cupboard holder group according to the present invention;

FIG. 6*b* is another perspective view of the wall cupboard holder group of FIG. 3;

FIG. 6*c* is an enlarged view of a detail of the wall cupboard holder group of FIGS. 6-6*b* assembled on the relative wall cupboard;

DETAILED DESCRIPTION OF THE INVENTION

With reference to the drawings, a visible adjustable wall cupboard holder group for anchoring a cupboard to the wall in question is indicated as a whole with 10.

Figure 1:
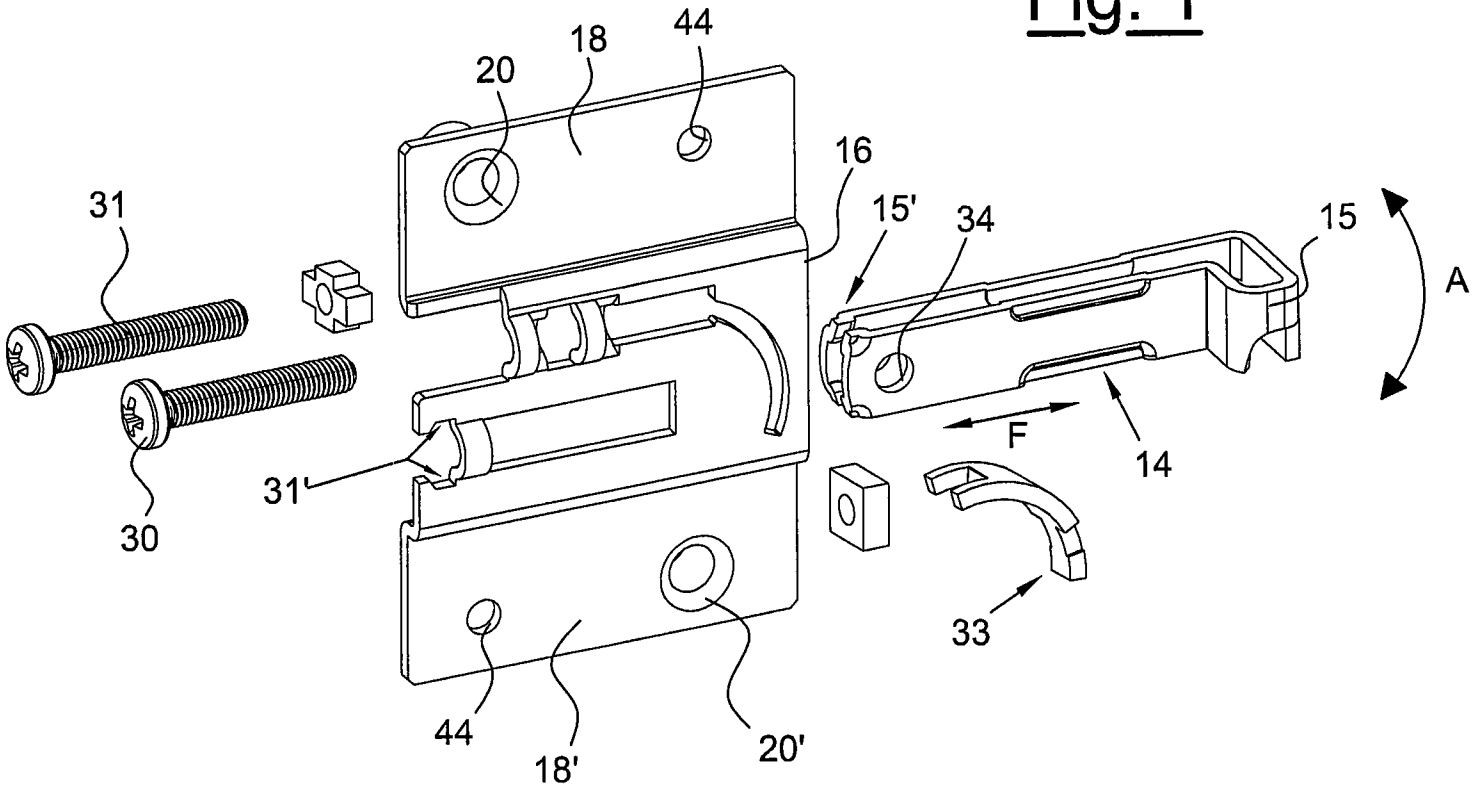
FIG. 1 is an exploded view of a visible wall cupboard holder group for anchoring a wall cupboard to the wall according to the present invention.

Said wall cupboard holder group 10 visible in exploded form in FIG. 1 and suitable for effecting the anchoring of a wall cupboard 11 to a wall, is fixed during use on one side to a internal side wall 12 of the relative wall cupboard 11 and on another, which at least partially protrudes externally from a hole 40 situated on a rear cover 13 of the same cupboard to a support (generally a metallic section) fixed to the wall (generally a metallic section).

Figure 7:
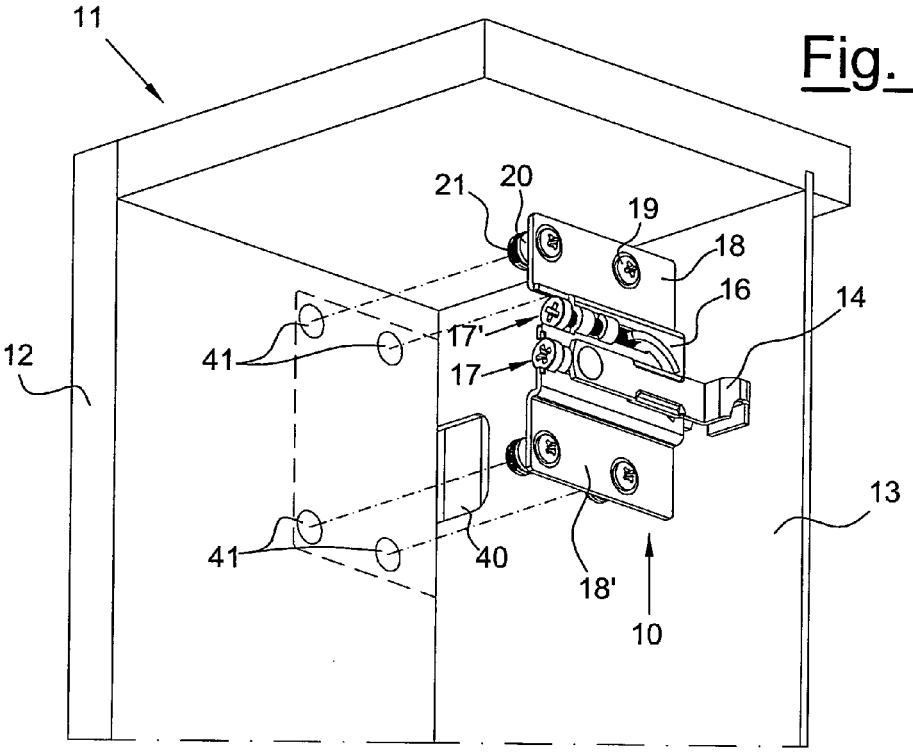
FIG. 7 is a perspective view of the wall cupboard holder group according to the present invention in the assembly phase on the relative wall cupboard.
Figure 7B:
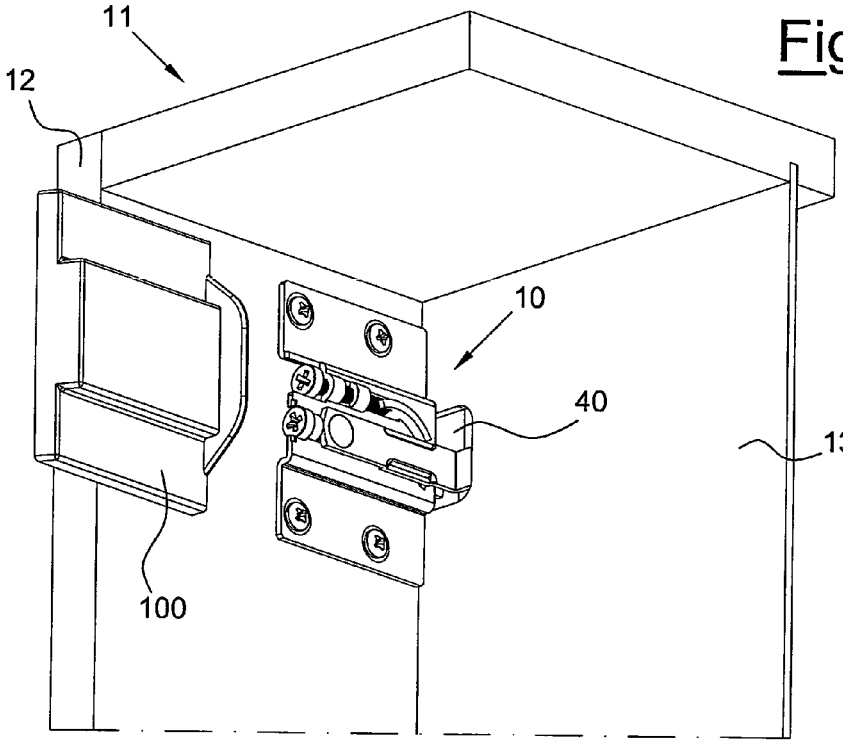
FIG. 7*b* is a perspective view of the wall cupboard holder group of FIG. 5 assembled on the relative wall cupboard.
Figure 8:
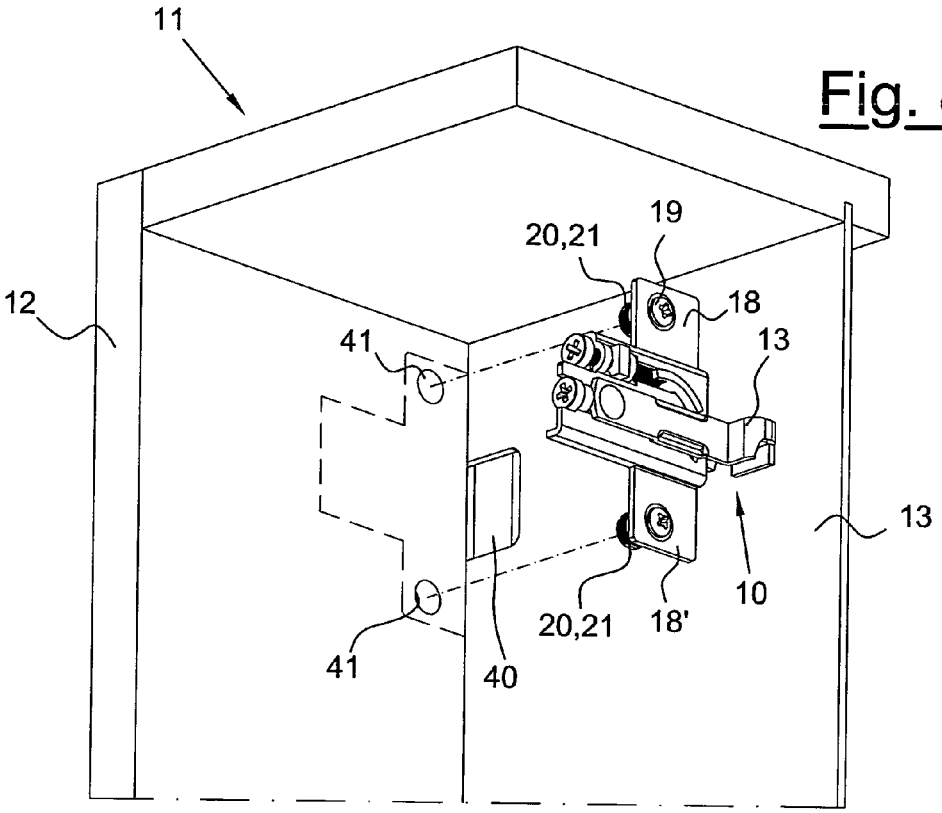
FIG. 8 is a perspective view of another wall cupboard holder group according to the present invention in the assembly phase on the relative wall cupboard.
Figure 8B:
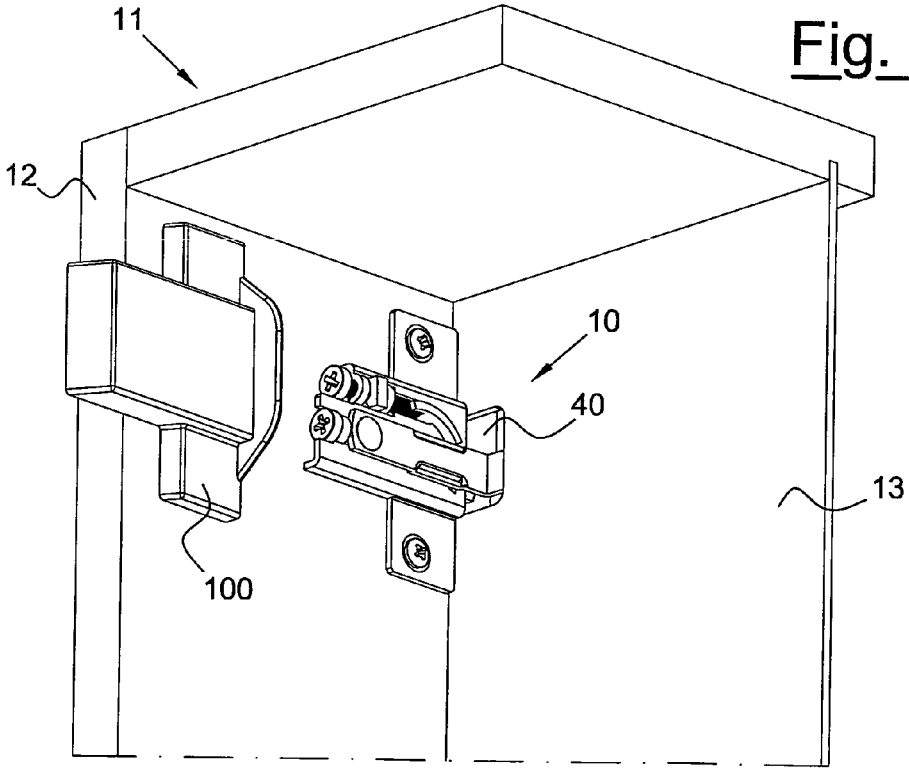
FIG. 8*b* is a perspective view of the wall cupboard holder group of FIG. 8 assembled on the relative wall cupboard.

An example of these assembly phases and relative couplings of the wall cupboard holder 10 in both the rear hole 40 and in the side holes 41 of the wall cupboard 11 are shown in FIGS. 7 and 8, whereas FIGS. 7*b* and 8*b* illustrate the same wall cupboard holders 10 at the end of the assembly with the relative rear portions 15 protruding beyond the cover 13 of the wall cupboard 11.

As can be easily seen, according to an embodiment of the invention, there is also a covering top 100, generally made of plastic, of the wall cupboard holder 10, which, however, has no structural function.

In particular, as clearly shown in FIG. 1, the wall cupboard holder 10 according to the invention comprises a hooking element 14 to a supporting element fixed to the wall, said hook 14 is coupled at a first end 15' to a central portion 16 of a plate element whereas at a second end, which freely protrudes behind the central portion 16, there is a hook-shaped fixing portion 15 to the above support.

In order to allow regulations of the position of the hook-shaped portion 15, the connection of the hooking element 14 to the central portion 16 is of the adjustable type in depth F and inclination A. For this purpose, regulation means 17, 17' of the depth F and inclination A of the hooking element 14 are envisaged, said means 17, 17' are associated with and easily accessible in the front to the central portion 16.

In this way, the user can proceed with all the regulations of the cupboard which he feels are necessary, in depth and height, as is well-known to experts in the field.

According to the invention, the wall cupboard holder 10 as described above, also comprises two side flanges 18, 18' which extend from the central portion 16 from opposite parts, above and below the hooking element 14, respectively, in which each of the two side flanges 18, 18' comprising fixing means 19, 19' of the wall cupboard holder group 10 to the inner side wall 12 (shoulder) of the wall cupboard 11, in addition to at least one element resistant to the shear forces 20, 20' which are generated when the wall cupboard holder 10 is assembled and when the wall cupboard is loaded.

Said at least one element resistant to shear forces 20, 20' protrudes from the side flanges 18, 18' on the side facing the inner side wall 12 of the wall cupboard 11, and collaborates with the previous fixing means 19, 19' for a stable positioning of the wall cupboard holder 10 on an internal wall 12 of the wall cupboard 11.

As can be seen in FIG. 1, the regulation means 17, 17' of the depth F and inclination A of the hooking element 14, which, as already mentioned, are associated with and easily accessible in the front to the central portion 16, comprise two screw-female screw mechanisms.

In these mechanisms, there is a first regulation screw 30 which comprises a head which is firmly housed/entrapped in a counter-form 31' situated in the central portion 16 and a threaded development which is longitudinally associated in an internal threaded seat of the hooking element 14 in correspondence with the end 15' of the hooking element 14 opposite the hook 15.

As can be deduced from what is stated above, said first regulation screw 30 is able to regulate the longitudinal movement (depth) of the hooking element 14.

A second regulation screw 31 is also envisaged, which is associated with the first central portion 16 in a parallel and upper position with respect to the first regulation screw 30.

Said second regulation screw 31 acts on a movable circular lunette 33 situated at the opposite side with respect to the head of the second regulation screw 31 and is driven by the second regulation screw 31 to enforce a rotation of the hooking element 14 around a riveted pin 34.

According to an embodiment shown in FIGS. 2-2*c*, the elements resistant to shear forces 20, 20' comprise at least one plug element 20, 20' protruding from the side flanges 18, 18' which are coupled, not necessarily forcedly (i.e. not necessarily with interference), with holes 41 situated in the internal side wall 12 of the wall cupboard 11.

As shown in FIG. 2*c*, said plugs 20, 20' collaborate with the previous fixing means 19, 19', for example screws, for a stable positioning of the wall cupboard holder 10 on the internal side wall 12 of the wall cupboard 11, preventing the misalignment of the wall cupboard holder 10 with respect to the relative wall cupboard 11.

In the above embodiment, the plug elements 20, 20' are integrally positioned directly on the side flanges 18, 18' during the production of the wall cupboard holder 10, but alternatively they can also be produced separately and subsequently welded onto the side flanges 18, 18' as shown in the embodiment of FIGS. 4-4*c*.

The plug elements so far described are preferably hollow cylindrical plugs with a circular section but, alternatively, and in relation to the type of cupboard to be coupled with the wall cupboard holder 10, they can be hollow cylindrical plugs having a circumferential arc section as shown in the embodiments of FIGS. 3-3*c*.

As already specified, the fixing means 19, 19' can comprise at least one fixing screw 19, 19' of the side flanges 18, 18' to the internal side wall 12 of the wall cupboard 11 in which said at least one fixing screw 19, 19' can be coupled with the side flanges 18, 18' in different positions with respect to the at least one plug element 20, 20' through relative holes 44.

Alternatively, the above screws 19, 19' can be coupled with the side flanges 18, 18' inside the plug elements 20, 20'.

According to another embodiment of the invention, the wall cupboard holder group 10 can comprise, as fixing means 19, 19', at least one expansion peg 21, 21' which can be optionally, but not necessarily, activated (radially expandable) by means of the screws 19, 19' and equipped with gripping teeth which, like the screws 19, 19' of the previous examples, fix the side flanges 18, 18' to the internal side wall 12 of the wall cupboard 11.

Said pegs 21, 21' can be coupled with the side flanges 18, 18' either in different positions with respect to the at least one plug element 20, 20', or, as shown in FIGS. 5-5*c*, coaxially with the relative screws 19, 19' to the at least one plug element 20, 20'.

Finally, according to a last embodiment, the fixing means comprise at least one expansion peg 21, 21' by means of cursors 22 with shaped heads which, like the previous pegs, fix the side flanges 18, 18' to the internal side wall 12 of the wall cupboard 11.

These pegs 21, 21' can also be coupled with the side flanges 18, 18' either in different positions or coaxially to the at least one plug element 20, 20' as shown in FIGS. 6-6*c*.

From the above description with reference to the figures, it is evident how a visible wall cupboard holder group for anchoring a wall cupboard to the wall according to the invention is particularly useful and advantageous. The objective indicated in the preamble of the invention has therefore been achieved.

The visible adjustable wall cupboard holder 10 for the assembly of a wall cupboard to a wall according to the present invention, in fact, ensures an easy and firm assembly on any type of wall cupboard preventing any possible misalignment of the wall cupboard holder 10 itself with respect to the relative cupboard also when the latter is loaded.

This firm positioning can be obtained and maintained in any loading condition of the cupboard thanks to the presence of the elements resistant to shear forces 20, 20' protruding from the side flanges 18, 18' inserted in the holes 41 of the internal side wall 12 of the wall cupboard 11.

In this condition, said elements resistant to shear forces 20, 20', such as cylindrical plugs, collaborate with the fixing means 19, 19', such as screws or expansion pegs and/or equipped with gripping teeth, to ensure a stable positioning of the wall cupboard holder group 10 on the internal wall 12 of the wall cupboard 11.

The forms of the visible wall cupboard holder group for the fixing of a wall cupboard to a wall, of the invention, as also the materials, can differ from those shown for purely illustrative and non-limiting purposes in the drawings.

The protection scope of the invention is therefore delimited by the enclosed claims.

The invention claimed is:

1. An adjustable wall cupboard holder group (10) for anchoring a wall cupboard (11) to a wall, said wall cupboard holder group (10) comprising a hooking element (14), adapted to engage a supporting element fixed to a wall having a first end and a second end, a central portion (16) affixed to the first end of said hooking element (14), said central portion (16) having regulation means (17, 17'), positioned therein for adjusting the depth and inclination of said hooking element (14), a hook (15) coupled to said first end of said hooking element (14), where said wall cupboard holder group (10) is adapted to be fixed on a side of wall cupboard (11), said central portion (16) having two side flanges (18, 18') which extend above and below said hooking element (14), respectively, both of said side flanges (18, 18') being adapted to be attached to a side of said wall cupboard (11) wherein each of said side flanges (18, 18') has at least one plug element (20, 20') which is resistant to shear forces when said wall cupboard is loaded and protrudes from each of said side flanges (18,18'), said plug elements (20, 20') are hollow cylindrical plugs with a circular section, (10) wherein said hollow cylindrical plug elements (20, 20') are integral with said side flanges (18, 18') or are welded onto said side flanges (18, 18'), said wall cupboard having holes (41) in an internal side wall (12) for coupling with said plug elements (20, 20') wherein each of said side flanges (18,18') comprise at least one fixing means (19, 19') for fixing said flanges (18, 18') to said side (12) of said wall cupboard (11), said regulation means (17, 17') for adjusting the depth and inclination of said hooking element (14) are accessible in the front of said central portion (16), and said regulation means comprise two screw-female screw mechanisms in which the head of a first regulation screw (30) is firmly housed in a counter-form (31) situated in said central portion (16), said first regulation screw (30) being longitudinally associated in an internal threaded seat of said hooking element (14) at an end (15') opposite to said hook (15) for the longitudinal movement of said hooking element (14), a second regulation screw (31) which is associated with said central portion (16) in a parallel and upper position with respect to said first regulation screw (30), said second regulation screw (31) acting on a movable circular lunette (33) enforcing a rotation of said hooking element (14) around a riveted pin (34) when said second regulation screw (31) is tightened, where said circular lunette (33) has an indentation that engages said end of said second regulation screw.

2. The adjustable wall cupboard holder group (10) according to claim 1, characterized in that said fixing means (19, 19') comprise at least one fixing screw for affixing said side flanges (18, 18') to said internal side wall (12) of a wall cupboard (11), said at least one screw being coupled with said side flanges (18, 18') in different positions with respect to at least one plug element (20, 20').

3. The adjustable wall cupboard holder group (10) according to claim 1, characterized in that said fixing means (19, 19') comprise at least one fixing screw in each of said side flanges (18, 18') for fixing said side flanges (18,18') to said internal side wall (12) of said wall cupboard (11), said at least one screw being coupled with said side flanges (18, 18') inside at least one plug element (20, 20').

4. The adjustable wall cupboard holder group (10) according to claim 1, characterized in that said fixing means (19, 19') comprise at least one expansion peg (21, 21') by means of screws (19, 19') with gripping teeth for fixing said side flanges (18, 18') to said internal side wall (12) of a wall cupboard (11), said at least one peg (21, 21') being coupled with said side flanges (18, 18') in different positions with respect to at least one plug element (20, 20').

5. The adjustable wall cupboard holder group (10) according to claim 1, characterized in that said fixing means (19, 19') comprise at least one expansion peg (21, 21') by means of fixing screws in each of said side flanges (18, 18') for fixing said wall cupboard holder group (10) to said internal side wall (12) of said wall cupboard (11), said at least one peg (21, 21') being coupled with said side flanges (18, 18') coaxially to at least one plug element (20, 20') and said screws inside said at least one plug element (20, 20').

6. The adjustable wall cupboard holder group (10) according to claim 1, characterized in that said fixing means (19, 19') comprise at least one expansion peg (21, 21') that is fixed by means of cursors (22) with a shaped fixing head on said side flanges (18, 18') to said internal side wall (12) of said wall cupboard (11), said at least one expansion peg (21, 21') being coupled with said side flanges (18, 18') coaxially to said at least one plug element (20, 20') and said cursors (22) inside said at least one plug element (20, 20').

7. An adjustable wall cupboard holder group (10) for anchoring a wall cupboard (11) to a wall, said wall cupboard holder group (10) comprising a hooking element (14), adapted to engage a supporting element fixed to a wall having a first end and a second end, a central portion (16) affixed to the first end of said hooking element (14), said central portion (16) having regulation means (17, 17') positioned therein for adjusting the depth and inclination of said hooking element (14), a hook (15) coupled to said first end of said hooking element (14) where said wall cupboard holder group (10) is adapted to be fixed on a side of wall cupboard (11), said central portion (16) having two side flanges (18, 18') which extend above and below said hooking element (14), respectively, both of said side flanges (18, 18') being adapted to be attached to a side of said wall cupboard (11) wherein each of said side flanges (18, 18') has at least one plug element (20, 20') which is resistant to shear forces when said wall cupboard is loaded and protrudes from each of said side flanges (18,18'), said plug elements (20, 20') are hollow cylindrical plugs with a circumferential arc section wherein each of said side flanges (18,18') comprise at least one fixing means (19, 19') for fixing said side flanges (18, 18') to said side (12) of said wall cupboard (11), and said wall cupboard having holes (41) in an internal side wall (12) for coupling with said plug elements (20, 20'), said regulation means (17, 17') for adjusting the depth and inclination of said hooking element (14) are accessible in the front of said central portion (16), and said regulation means comprise two screw-female screw mechanisms in which the head of a first regulation screw (30) is firmly housed in a counter-form (31) situated in said central portion (16), said first regulation screw (30) being longitudinally associated in an internal threaded seat of said hooking element (14) at an end (15') opposite to said hook (15) for the longitudinal movement of said hooking element (14), a second regulation screw (31) which is associated with said central portion (16) in a parallel and upper position with respect to said first regulation screw (30), said second regulation screw (31) acting on a movable circular lunette (33) enforcing a rotation of said hooking element (14) around a riveted pin (34) when said second regulation screw (31) is tightened, where said circular lunette (33) has an indentation that engages said end of said second regulation screw.

8. An adjustable wall cupboard holder group (10) for anchoring a wall cupboard (11) to a wall, said wall cupboard holder group (10) comprising a hooking element (14), adapted to engage a supporting element fixed to a wall having a first end and a second end, a central portion (16) affixed to the first end of said hooking element (14) said central portion (16) having regulation means (17, 17') positioned therein for adjusting the depth and inclination of said hooking element (14), a hook (15) coupled to said first end of said hooking element (14) where said wall cupboard holder group (10) is adapted to be fixed on a side of wall cupboard (11), said central portion (16) having two side flanges (18, 18') which extend above and below said hooking element (14), respectively, said hooking element (14) being firmly housed in a counter-form (31) situated in said central portion (16), both of said side flanges (18, 18') having a flat surface adapted to be attached to a side of said wall cupboard (11) wherein each of said side flanges (18, 18') has at least one plug element (20, 20') which is resistant to shear forces when said wall cupboard is loaded and protrudes from each of said side flanges (18,18'), said plug elements (20, 20') are hollow cylindrical plugs with a circular section, (10) wherein said hollow cylindrical plug elements (20, 20') are integral with said side flanges (18, 18') or are welded onto said side flanges (18, 18'), said wall cupboard having holes (41) in an internal side wall (12) for coupling with said plug elements (20, 20') wherein each of said side flanges (18,18') comprise at least one fixing means (19, 19') for fixing said side flanges (18, 18') to said side (12) of said wall cupboard (11) where said fixing means (19, 19') comprises at least one expansion peg (21, 21') that is fixed by means of cursors (22) with a shaped fixing head on said side flanges (18, 18') to an internal side wall (12) of said wall cupboard (11), said at least one expansion peg (21, 21') being coupled with said side flanges (18, 18') coaxially to said at least one plug element (20, 20') and said cursors (22) inside said at least one plug element (20, 20') said regulation means (17, 17') for adjusting the depth and inclination of said hooking element (14) are accessible in the front of said central portion (16), and said regulation means comprise two screw-female screw mechanisms in which the head of a first regulation screw (30) is firmly housed in a counter-form (31) situated in said central portion (16), said first regulation screw (30) being longitudinally associated in an internal threaded seat of said hooking element (14) at an end (15') opposite to said hook (15) for the longitudinal movement of said hooking element (14), a second regulation screw (31) which is associated with said central portion (16) in a parallel and upper position with respect to said first regulation screw (30), said second regulation screw (31) acting on a movable circular lunette (33) enforcing a rotation of said hooking element (14)

around a riveted pin (34) when said second regulation screw (31) is tightened, where said circular lunette (33) has an indentation that engages said end of said second regulation screw and a top surface that is smooth.

* * * * *